United States Patent [19]

Yong

[11] Patent Number: 5,056,841

[45] Date of Patent: Oct. 15, 1991

[54] CHOPSTICKS

[76] Inventor: Yim-Fong Yong, Carrera 66 No. 14-41, Bogotá D.E., Colombia

[21] Appl. No.: 492,195

[22] Filed: Mar. 13, 1990

[51] Int. Cl.[5] ..... A47G 21/00

[52] U.S. Cl. ..... 294/1.1; 294/5.5; 294/23.5

[58] Field of Search ..... 294/1.15, 5.5, 8.5, 294/11, 15, 16, 19.1, 23.5, 33, 87.11, 99.2; D7/42, 75, 99, 102, 137, 138, 152, 642, 683, 688; 30/123, 124, 137, 142, 150, 322, 324, 340; 426/134

[56] References Cited

U.S. PATENT DOCUMENTS

| | | | |
|---|---|---|---|
| 1,813,292 | 7/1931 | Hord | 294/5.5 |
| 1,847,415 | 3/1932 | Snell | 294/5.5 |
| 2,607,988 | 8/1952 | Williams | 30/322 |
| 2,711,339 | 6/1955 | McGogy | 294/99.2 |
| 3,125,038 | 3/1964 | Amato | 294/5.5 X |
| 3,186,749 | 6/1965 | Dawes | 294/99.2 |
| 3,995,902 | 12/1976 | Sciaino | 294/5 |
| 4,141,578 | 2/1979 | Zinder | 426/134 X |
| 4,312,530 | 1/1982 | Yong | 294/99.2 X |
| 4,639,376 | 1/1987 | Saladino et al. | 294/1.1 X |
| 4,707,922 | 11/1987 | Hosak-Robb | 294/99.2 X |
| 4,717,190 | 1/1988 | Witherspoon | 294/99.2 |

FOREIGN PATENT DOCUMENTS

| | | | |
|---|---|---|---|
| 459370 | 9/1949 | Canada | 294/23.5 |
| 970972 | 1/1951 | France | 294/99.2 |
| 260049 | 2/1949 | Switzerland | 30/322 |
| 1259920 | 1/1972 | United Kingdom | 294/1.1 |

*Primary Examiner*—Johnny D. Cherry
*Attorney, Agent, or Firm*—Browdy and Neimark

[57] ABSTRACT

Attractive, inexpensive, sanitary and effective chopsticks are formed of elongated, hollow tubular elements formed of relatively rigid, non-toxic plastic having closed upper and lower ends. Corrugated portions are provided near the lower ends which extend substantially entirely about the hollow tube so as to provide an improved gripping surface.

9 Claims, 1 Drawing Sheet

CHOPSTICKS

FIELD OF THE INVENTION

The present invention relates to oriental eating utensils, namely "chopsticks", and more particularly to improved chopsticks which are attractive, inexpensive and thus readily disposable, sanitary and effective.

BACKGROUND OF THE INVENTION

Traditional chopsticks are formed of wood. Of course, wood is a porous material and consequently the re-use of wooden chopsticks, particularly by other persons such as in a restaurant or other public setting, creates potential health problems. Also, as wood has become increasingly more expensive, it would be desirable to provide disposable chopsticks which are less costly than wooden chopsticks.

It has been proposed to form chopsticks of molded plastic, i.e. injection molded plastic. The Dawes U.S. Pat. No. 3,186,749 discloses molded plastic chopsticks; also see the Hosak-Robb U.S. Pat. 4,707,922. One problem with plastic, however, is that its surface is exceedingly slippery, and thus plastic chopsticks are difficult to use, particularly for those who do not have substantial experience in eating with these utensils. This problem is solved by Dawes by forming tip end gripping faces which are knurled or otherwise roughened to provide a better grip on the food which is intended to be grasped. However, two problems exist with regard to the Dawes solution, namely the roughening operation requires a additional processing step thus increasing the cost of manufacture, and furthermore this solution is particularly adapted to the spring-connected chopsticks of Dawes which are clipped together so that the inclined facing surfaces, roughened as indicated above, always come into contact with one another.

Also of interest is the Young U.S. Pat. No. 4,312,530 which shows a hinged chopsticks assembly and the McGogy U.S. Pat. No. 2,711,339 entitled "Tongs" which shows a pair of chopsticks held together with a spring metal holder. In both of these constructions, the lower ends of the chopsticks are provided with corrugated ridges or serrations, presumably for the purpose of increasing friction to facilitate the use of these chopsticks constructions in order to better hold the food therebetween without slippage. In all these cases, however, the roughened or serrated portion is limited only to the lowermost portion of each stick, and only on predetermined facing surfaces which are fixed in each case by the spring guide or hinge construction. These configurations are unsuitable for unhinged or unconnected chopsticks used in the conventional manner.

In addition to the problems mentioned above, the use of plastic in the manufacture of chopsticks has resulted in two further problems. First, as already mentioned above, the public has become increasingly concerned with diseases such as hepatitis and salmonella, and therefore even eating utensils which are more easily cleaned than those formed of wood are of increasing concern. While plastic chopsticks can of course be more easily washed, many plastics including the least expensive plastics are not heat tolerant. To be able to wash plastic chopsticks in an effective manner requires the use of very hot water, and certain plastics cannot tolerate these conditions. Second, due to the rising cost of plastics, the conventional plastic chopsticks are too expensive for a single use. Therefore, the need exists for chopsticks which are sufficiently inexpensive so that they can be thrown away after one use.

SUMMARY OF THE INVENTION

It is, accordingly, an object of the present invention to overcome deficiencies of the prior art, such as indicated above.

It is another object of the present invention to provide chopsticks which may be readily used in the fashion of conventional chopsticks, which are made of plastic, and which are provided with corrugations near the bottom ends thereof which extend entirely about the circumference making the picking up of food easy regardless of the orientation of the two sticks relative to one another.

A further object of the present invention is to provide lightweight and inexpensive chopsticks made entirely of plastic.

Still another object of the present invention is to provide hollow chopsticks thereby making them both lighter and less costly.

Yet another object of the present invention is to provide disposable chopsticks which are sufficiently inexpensive and economical for them to be thrown away by restaurants after a single use.

Still a further object of the present invention is to provide hygienic chopsticks made out of disposable and non-toxic plastic.

These and other objects and the nature and advantages of the present invention will be more apparent from the following detailed description, taken in conjunction with the drawing, wherein:

DETAILED DESCRIPTION OF EMBODIMENTS

Figure 1:
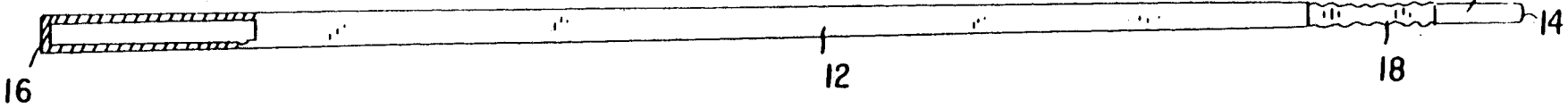
FIG. 1 is an elevation view, partly in section, of a first embodiment of a chopstick in accordance with the present invention.

FIG. 1 shows a first embodiment 10 of a chopstick in accordance with the present invention, two of which are used in the conventional oriental eating style.

Figure 2:
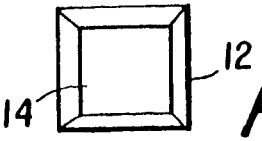
FIG. 2 is an end view of the chopstick of FIG. 1, looking toward the small or bottom end at the right side of FIG. 1.

The chopstick 10 comprises an elongated, hollow tube 12 formed of rigid non-toxic plastic and having a lower closed end 14 and an upper closed end 16. As best seen in FIG. 2, the hollow tube 12 has a sidewall of rectangular, preferably square, cross-section, and gradually tapers in a progressive and uniform fashion from the upper closed end 16 to the lower closed end 14. It will be understood, however, that such tapering need not necessarily be substantially uniform along its length, but can vary in sections or vary gradually, if desired; or the taper may be eliminated substantially entirely, if desired.

The chopstick 10 is provided along its length with three distinct sections, including an upper handle section which in the preferred embodiments constitutes approximately 80% or more of its length, an intermediate corrugated grasping portion 18 located near the closed lower end 14, and a lower tip portion 20 between the intermediate corrugated portion 18 and the closed lower end 14. Each of the intermediate and tip portions 18 and 20 constitute about 2–10% of the total length of the chopstick 10, and in the most preferred embodiment the intermediate corrugated portion has a length of about 18 mm and the tip portion 20 has a length of about 13 mm.

The intermediate corrugated portion 18 is constructed so as to facilitate the grasping of the food between the two chopsticks when the chopsticks are used in the conventional oriental fashion. In order to accomplish this function, the corrugations extend substantially entirely about the periphery of the sidewall, i.e. when the sidewall of the tube 1 constitutes flat faces as is the case with chopstick 10, the corrugations appear on all four faces. Also, such corrugations are axially spaced from one another and each corrugation extends along a radial plane. On the other hand, it will be understood that the corrugations need not necessarily be continuous, i.e. they can be interrupted with one or more axially extending gaps which are relatively smooth, it being understood that it is only necessarily that the corrugations face toward the food regardless of the orientation of the chopsticks in the hand of the user.

Figure 3:
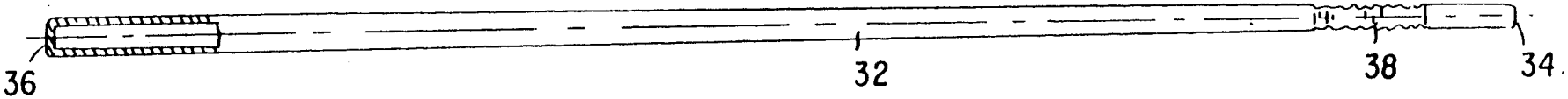
FIG. 3 is an elevation view, partly in section, of a second embodiment of a chopstick in accordance with the present invention.
Figure 4:
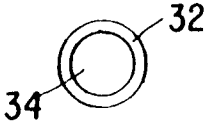
FIG. 4 is an end view of the chopstick of FIG. 3, looking toward the small or bottom end at the right side of FIG. 3.

FIGS. 3 and 4 show a second embodiment 30 similar to the embodiment 10 of FIG. 1, except that the tube 32 has a circular cross-section as best seen in FIG. 4. The intermediate corrugated portion 38 similarly has a series of corrugations extending substantially entirely about the sidewall, but again such corrugations may be interrupted by thin smooth portions.

The chopsticks of the present invention are formed by conventional molding techniques from relatively rigid, non-toxic plastics, preferably those are which are relatively inexpensive such as PVC (unplasticized or only slightly plasticized with nontoxic plasticizer), polystyrene or polyolefin, e.g. polypropylene or polyethylene. Of course, more expensive plastics can also be used, but those are not preferred. If desired, the plastics can be colored by suitable non-toxic pigments or dyes.

As indicated above, conventional molding techniques can be used. Preferably, the chopsticks of the present invention are formed by blow molding or extrusion, followed by reshaping the ends to close same. Injection molding followed by reshaping the ends to close same can also be used. Preferably, however, a preform is formed by extrusion or injection molding followed by reshaping using blow molding or suction molding, in turn followed by reshaping the ends to close same.

As noted above, the plastics utilized according to the invention are not only non-toxic and inexpensive, but preferably are those which are relatively stiff, because the finished chopstick must be sufficiently stiff so as to resist bending during usage. In view of the stiffness requirements, it is desirable to have a wall thickness which is relatively great compared to, for example, a drinking straw. In practice, it has been found that depending on the precise plastic material used, the wall thickness should be at least about a minimum of 10% of the average width or diameter of the tube. If the wall thickness reaches about 20% of the average width or the diameter of the tube, increased thickness of the wall does not result in any substantial further benefit and the cost increases because of the greater quantity of plastic material used. Thus, it is preferred that the wall thickness be about 10–20% of the average width or diameter of the tube.

In preferred embodiments consistent with FIGS. 1 and 2 and FIGS. 3 and 4, the wall thickness of the tube is 0.8 mm and the length of the chopstick is 24 cm. In the example consistent with FIGS. 3 and 4, the outer diameter immediately above the closed lower end 34 is 44 mm and the outer diameter immediately below the closed upper end 36 is 57 mm. In the example consistent with FIGS. 1 and 2, the width immediately above the lower end 14 is 44 mm and the width immediately below the upper end 16 is 57 mm.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A pair of chopsticks eating utensils, each of said chopsticks comprising an elongated, hollow tube formed of rigid non-toxic plastic and having a lower closed end and an upper closed end, said tube having a sidewall of sufficient thickness to make said tube rigid, said tube having an intermediate corrugated portion near said lower closed end, said intermediate corrugated portion comprising a series of axially spaced corrugations extending substantially entirely about said sidewall.

2. A pair of chopsticks according to claim 1, wherein said hollow tube is slightly tapered from a larger cross-section at said upper end to a smaller cross-section at said lower end.

3. A pair of chopsticks according to claim 2, wherein said taper is substantially uniform.

4. A pair of chopsticks according to claim 1, wherein said tube has a circular cross-section.

5. A pair of chopsticks according to claim 1, wherein said tube has a rectangular cross-section.

6. A pair of chopsticks according to claim 1, wherein said sidewall has a wall thickness of about 10–20% of an average width of said tube.

7. A pair of chopsticks according to claim 1, wherein said intermediate corrugated portion is spaced from said closed lower end by a tip portion having a length on the order of about 2–10% of the overall length of said tube.

8. A pair of unconnected chopsticks eating utensils, each said chopstick comprising:

an elongated, hollow tube formed of rigid non-toxic plastic and having a lower closed end and an upper closed end, said tube having a sidewall of sufficient thickness to make said tube rigid, said thickness being on the order of about 10–20% of an average width of said tube, said tube having an intermediate corrugated portion near said closed lower end, said intermediate corrugated portion comprising a series of corrugations extending substantially entirely about said sidewall, said intermediate corrugated portion being spaced from said closed lower end by a tip portion having a length on the order of about 2–10% of the overall length of said tube, and said corrugated portion having a length on the order of about 2–10% of the overall length of said tube.

9. A pair of chopsticks according to claim 8 wherein said corrugations of said series of corrugations are axially spaced from one another, each corrugation extending substantially along a radial plane.

* * * * *